United States Patent [19]

Eheim

[11] 4,442,810

[45] * Apr. 17, 1984

[54] REGULATING DEVICE FOR A FUEL INJECTION PUMP

[75] Inventor: Franz Eheim, Stuttgart, Fed. Rep. of Germany

[73] Assignee: Robert Bosch GmbH, Stuttgart, Fed. Rep. of Germany

[ * ] Notice: The portion of the term of this patent subsequent to Mar. 9, 1999 has been disclaimed.

[21] Appl. No.: 409,249

[22] Filed: Aug. 18, 1982

[30] Foreign Application Priority Data

Sep. 29, 1981 [DE] Fed. Rep. of Germany ..... 3138640

[51] Int. Cl.[3] ..... F02D 31/00

[52] U.S. Cl. ..... 123/357; 123/503

[58] Field of Search ..... 123/357, 358, 359, 503, 123/449; 417/289

[56] References Cited

U.S. PATENT DOCUMENTS

| | | | |
|---|---|---|---|
| 3,630,643 | 12/1971 | Eheim et al. | 123/503 |
| 3,661,130 | 5/1972 | Eheim | 123/357 |
| 4,318,378 | 3/1982 | Eheim | 123/357 |
| 4,325,337 | 4/1982 | Eheim et al. | 123/357 |
| 4,345,563 | 8/1982 | Eheim | 123/357 |
| 4,380,221 | 4/1983 | Eheim | 123/357 |

*Primary Examiner*—Charles J. Myhre
*Assistant Examiner*—Magdalen Moy
*Attorney, Agent, or Firm*—Edwin E. Greigg

[57] ABSTRACT

A regulating device for the supply quantity of an injection pump for internal combustion engines having an electromagnet system as a component of a fuel quantity final control element is proposed. The fuel quantity final control element effects the controlling position of a control member, which fixes the supply onset or end by the injection pump through the closing or opening, respectively, of a relief conduit of the pump work chamber. The fuel quantity final control element includes a linear magnet, which is operationally connected with the control member. In order to transmit the stroke movement or displacement of the armature of the linear magnet onto the control member, a transmission member is provided which includes a rotatably supported adjusting shaft, a crank and an eccentric. The crank and the eccentric are disposed on opposite ends of the adjusting shaft and protrude in opposite directions from one another.

10 Claims, 3 Drawing Figures

REGULATING DEVICE FOR A FUEL INJECTION PUMP

BACKGROUND OF THE INVENTION

The invention relates to a device for finely regulating the quantity of fuel delivered to cylinders by a fuel injection pump, and more specifically to an improvement thereof in which a linear magnet is coupled, via eccentric motion transmitting structure, to a sleeve disposed on the reciprocating fuel delivering pump piston so that the sleeve is linearly displaced along the piston thereby selectively blocking piston carried conduits, resulting in adjustment of fuel quantities delivered to the cylinders.

A regulating device of this kind is already known from U.S. Pat. No. 4,318,378, in which a lever cooperating with the armature of the linear magnet is provided for transmitting the stroke movement of displacement of the armature onto the control member; the lever is supported on a shaft and is functionally connected with the control member. This regulating device has the disadvantage, however, that a second lever is required for the fine adjustment of the lever shaft with respect to the control member position which is to be established. This lever shaft is secured on the second lever, and additional means are required for adjusting this second lever.

OBJECT AND SUMMARY OF THE INVENTION

The regulating device according to the invention has the advantage over the prior art that the means provided for transmitting the stroke movement or displacement of the armature of the linear magnet do not necessitate additional means for finely adjusting them.

The instant invention will be better understood and further objects and advantages thereof will become more apparent from the ensuing detailed description of a preferred embodiment taken in conjunction with the drawings.

DESCRIPTION OF THE PREFERRED EMBODIMENT

Figure 1A:
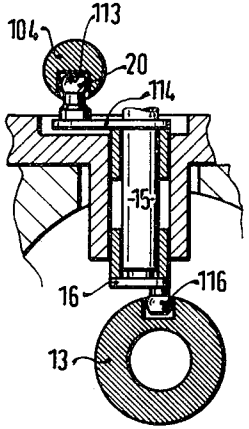
FIG. 1*a* shows the transmission means according to the invention in a section taken along the line a—a of FIG. 1.
Figure 1:
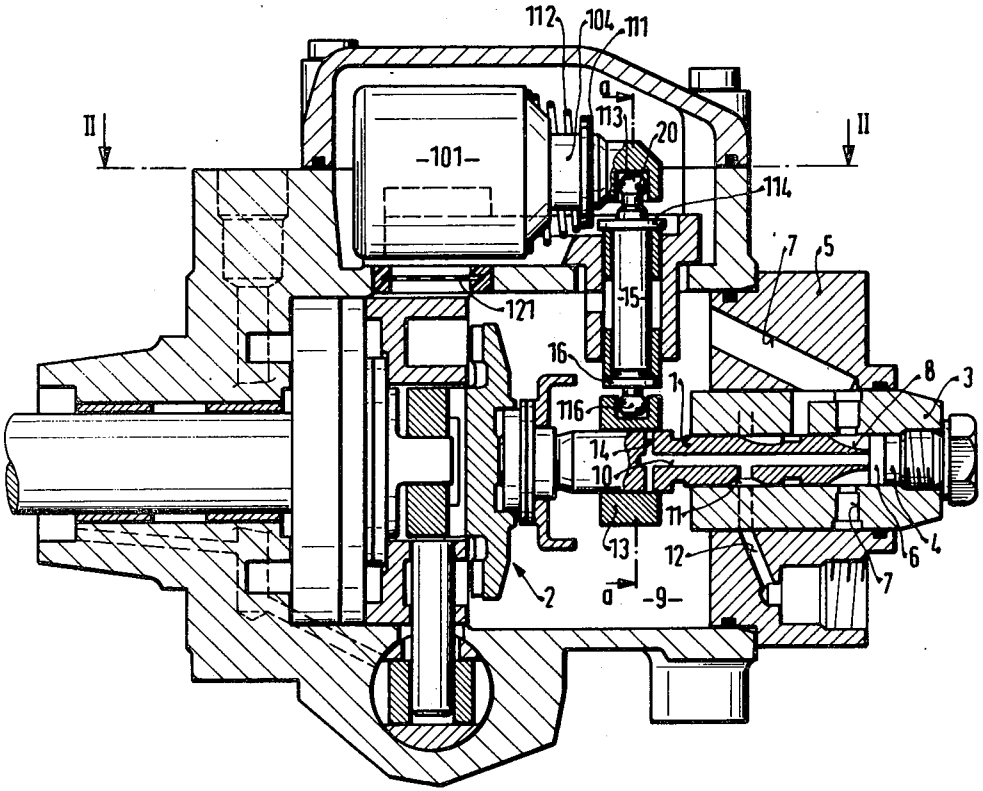
FIG. 1 shows a distributor-type injection pump, seen partially in section, which includes the transmission means according to the invention.
Figure 2:
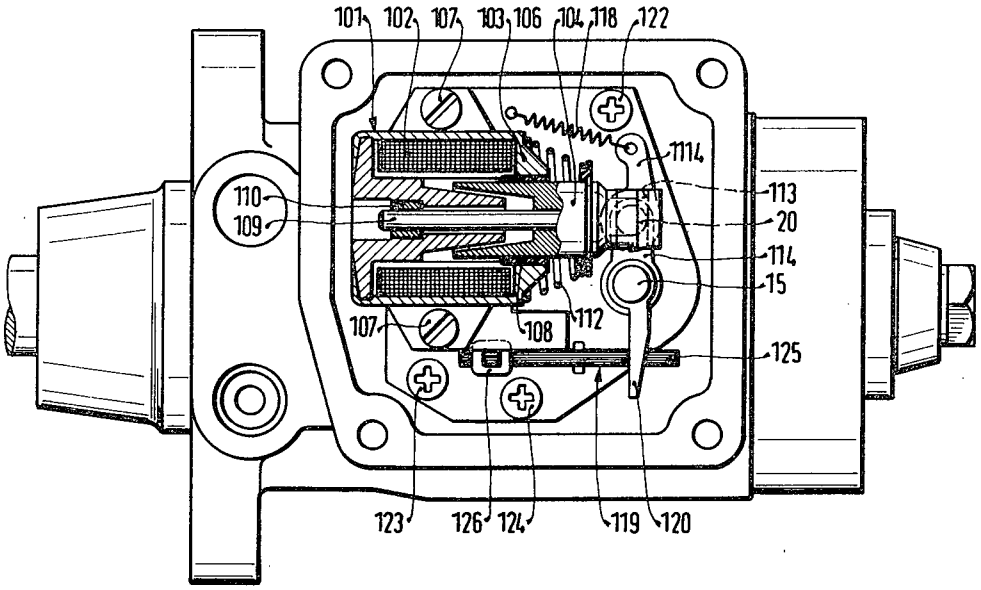
FIG. 2 is a section taken along the line II—II of FIG. 1.

As shown in FIG. 1, a pump piston 1 of a fuel injection pump is set into simultaneous reciprocal and rotary motion by a cam drive 2. The pump piston 1, a bushing 3 and a plug 4 define a pump work chamber 6. The bushing 3 is disposed in a housing 5. During the intake stroke of the pump piston 1, the pump work chamber 6 is supplied with fuel from a suction chamber 9 via intake conduits 7 and intake grooves 8. During the compression stroke of the pump piston 1, fuel is pumped out of the pump work chamber 6 via a bore 10 disposed in the pump piston 1 and via a longitudinal distributor groove 11 into pressure conduits 12, which are disposed about the distributor piston 1, the pressure conduits 12 corresponding in number to the number of engine cylinders to be supplied with fuel with each pressure conduit 12 leading to one engine cylinder. The regulation of the fuel quantity is effected via an annular regulating slide 13 disposed about the pump piston 1. This regulating slide controls the quantity of fuel flowing through a transverse bore 14 extending perpendicularly to the longitudinal bore 10 of the pump piston 1. Thus fuel injection begins only when the transverse bore 14 is blocked via the regulating slide 13 during the compression stroke of the pump piston 1. Depending upon the position assumed by the regulating slide 13, this blockage of the transverse bore 14 occurs earlier or later; in other words, the quantity of fuel injection is larger or smaller.

The regulating slide 13 is actuated via an eccentric 16, which is secured on an adjusting shaft 15 and is coupled via a ball 116 with the regulating slide 13. The adjusting shaft 15 is a component of a crank 114.

A further component of the crank 114 is a ball 20, which engages the groove 113 of the armature 104 of a linear magnet 101. The yoke of this linear magnet 101 is indicated by reference numeral 103, and the coil of the linear magnet is indicated by reference numeral 102. The magnetic force acts via a spring plate 111 upon a conically embodied regulating spring 112 acting as a compression spring. Thus, with a decreasing distance between the armature 104 and the yoke 103, the force of the magnet increases. On their ends facing each other, the armature 104 and the yoke 103 are embodied as conical for a part of their length, in order to effect a certain linearization over the course of the stroke or displacement and a more favorable course of the lines of force, and thus of the control variable of the magnet.

The linear magnet 101 is secured on a bearing block 106 with screws 107. The armature 104 is doubly supported, first in the Teflon bushing 108 and second in the second bearing bushing 110 via the guide rod 109, which is firmly pressed into the armature 104. The tension spring 118 serves as a play-compensating means.

The displacement of the armature 104 and thus the rotation of the adjusting shaft 15 is measured by means of a short-circuit ring transducer 119 acting as a fuel quantity feedback means; this is accomplished in that a ferromagnetic core 125, on which an induction coil 126 is disposed, protrudes into a short-circuit ring 120, which is firmly connected with the adjusting shaft 15. The position of the short-circuit ring 120 corresponds to the position of the regulating slide 13 and is thus a standard for the injected fuel quantity.

The complete final control element is embodied as a unit, and it is inserted as such into the pump housing. The magnet chamber is separated from the suction chamber of the injection pump by the filter 121.

Adjustment is effected by rotating the entire final control element unit about the securing screw 122 with the aid of an adjusting screw 123, which is provided with a conical head. Once an adjustment procedure has been completed, the screw 124 is tightened. However, it is also alternatively possible to perform this adjustment via an axially disposed adjusting screw.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection pump for internal combustion engines, including a reciprocating pump piston having conduit means for distributing pumped fuel to respective engine cylinders, and means for precisely regulating the quantity of fuel pumped, during the compression stroke of said piston, to said cylinders, the improvement comprising:

annular means disposed about said piston for selectively blocking said conduits, electromagnetic means for adjusting the position of said blocking means along said piston means, said adjusting means comprises a linear magnet and means, coupling said adjusting means to said blocking means, for transmitting motion of said former to said latter, whereby adjustment of the position of said blocking means along said piston results in said conduit means being selectively blocked at varying times during said compression stroke thus producing larger or smaller quantities of injected fuel and said blocking means comprises a sleeve slidable axially over the piston.

2. The improvement of claim 1 wherein said transmitting means comprises a rotatably supported adjusting shaft having a crank at one end and an eccentric at the opposite end.

3. An improvement of claim 2 wherein the crank is functionally connected with said adjusting means, and the eccentric is functionally connected with said blocking means.

4. The improvement of claim 3, wherein said crank includes a ball attached to its controlling end, said ball engaging a grooved portion of said adjusting means thereby interconnecting said shaft with said adjusting means.

5. The improvement of claim 3, wherein said crank further includes an elongated arm having one end engaged by a play-compensating, tension spring and its opposite end fixedly secured within said pump.

6. The improvement of any one of claims 1, 2–5, wherein the magnetic force of said adjusting means acts via a spring plate upon a conical regulating compression spring.

7. The improvement of any one of claims 1, 2–5, wherein said adjusting means comprises an armature and a cooperating yoke which on adjacent ends are conical for part of their length.

8. The improvement of claim 7 wherein said armature is linearly displaceable relative to said yoke, the armature lying within the vicinity of said yoke at the outer extent of its displacement, said yoke including a cylindrical jacket face having a central opening in which said armature is received, and a bushing lining said opening and secured on said yoke at one end thereof.

9. The improvement of claim 7, further including a guide rod extending in the direction of displacement of the armature and interconnecting said armature with said yoke for supplementally guiding said armature within said yoke, said guide rod being guided within a second bush which is similarly secured on said yoke at an opposite end thereof.

10. The improvement of claim 8 in which the displacement of the armature is measured by a short-circuit ring transducer acting as a fuel quantity feedback means, a ferromagnetic core about which an induction coil is disposed, said core protruding into a short-circuit ring, the latter being firmly connected to said transmitting means.

* * * * *